US008470291B2

(12) United States Patent
Fournier et al.

(10) Patent No.: US 8,470,291 B2
(45) Date of Patent: Jun. 25, 2013

(54) PROCESS TO PREPARE A GAS MIXTURE OF HYDROGEN AND CARBON MONOXIDE

(75) Inventors: Guillaume Guy Michel Fournier, Amsterdam (NL); Wouter Koen Harteveld, Amsterdam (NL); Albert Joseph Hendrik Janssen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 65 days.

(21) Appl. No.: 12/576,169

(22) Filed: Oct. 8, 2009

(65) Prior Publication Data

US 2010/0090167 A1 Apr. 15, 2010

Related U.S. Application Data

(60) Provisional application No. 61/103,978, filed on Oct. 9, 2008.

(30) Foreign Application Priority Data

Oct. 8, 2008 (EP) ..... 08166068

(51) Int. Cl.
*C01B 3/24* (2006.01)
*C01B 3/38* (2006.01)

(52) U.S. Cl.
USPC ..... 423/650; 252/373

(58) Field of Classification Search
USPC ..... 252/373; 423/650
See application file for complete search history.

(56) References Cited

U.S. PATENT DOCUMENTS

| | | | | |
|---|---|---|---|---|
| 2,699,384 A | | 1/1955 | Peery | 48/206 |
| 2,871,114 A | | 1/1959 | Du Bois Eastman | 48/206 |
| 3,232,727 A | | 2/1966 | Guptill, Jr. et al. | 48/215 |
| 3,929,429 A | | 12/1975 | Crouch | 48/201 |
| 4,205,963 A | * | 6/1980 | Marion et al. | 48/197 R |
| 4,218,423 A | * | 8/1980 | Robin et al. | 422/207 |
| 4,402,709 A | | 9/1983 | Stellaccio | 48/197 R |
| 4,437,417 A | | 3/1984 | Roberts | 110/346 |
| 4,474,584 A | | 10/1984 | Koog | 48/197 |

(Continued)

FOREIGN PATENT DOCUMENTS

| | | |
|---|---|---|
| AU | 532788 | 10/1983 |
| CA | 2250133 | 10/1997 |

(Continued)

OTHER PUBLICATIONS

Perry's Chemical Engineers' Handbook, 7th edition, Robert H. Perry, McGraw-Hill Companies, 1997, ISBN 0-07-049841-5, pp. 18-113-18-115.

*Primary Examiner* — Melvin C Mayes
*Assistant Examiner* — Kenneth Vaden

(57) ABSTRACT

Process to prepare a gas mixture of hydrogen and carbon monoxide from an ash containing carbonaceous feedstock by performing the following steps, (i) partial oxidation of the ash containing carbonaceous feedstock with an oxygen containing gas thereby obtaining liquid ash and a gas mixture comprising hydrogen, carbon monoxide and solids, (ii) separating more than 90 wt % of the liquid ash from the gas mixture, (iii) reducing the temperature of the gas mixture, in the absence of the separated ash (iv) scrubbing the cooled gas of step (iii) by contacting with liquid water obtaining a scrubbed gas and a water effluent containing ash, (v) separating the ash from the water effluent by means of a decanter centrifuge thereby obtaining a wet ash and a stream of water poor in ash.

8 Claims, 2 Drawing Sheets

U.S. PATENT DOCUMENTS

| | | | | | |
|---|---|---|---|---|---|
| 4,502,869 | A | | 3/1985 | Jahnke et al. | 48/197 R |
| 4,523,529 | A | | 6/1985 | Poll | 110/263 |
| 4,887,962 | A | * | 12/1989 | Hasenack et al. | 110/263 |
| 5,410,874 | A | | 5/1995 | Limerick | 60/267 |
| 2004/0116765 | A1 | | 6/2004 | Grootveld et al. | 585/800 |

FOREIGN PATENT DOCUMENTS

| | | |
|---|---|---|
| EP | 400740 | 12/1990 |
| EP | 416242 | 3/1991 |
| EP | 662506 | 7/1995 |
| EP | 1066103 | 1/2001 |
| GB | 1119699 | 7/1968 |
| GB | 1259425 | 1/1972 |
| WO | WO0121736 | 3/2001 |
| WO | WO02081600 | 10/2002 |
| WO | WO2004005438 | 1/2004 |
| WO | WO2006117355 | 9/2006 |
| WO | WO2007125046 | 11/2007 |
| WO | WO2007125047 | 11/2007 |
| WO | WO2008077233 | 7/2008 |
| WO | WO2008138989 | 11/2008 |

* cited by examiner

PROCESS TO PREPARE A GAS MIXTURE OF HYDROGEN AND CARBON MONOXIDE

This application claims the benefit of European Application No. 08166068.0 filed Oct. 8, 2008 and U.S. Provisional Application No. 61/103,978 filed Oct. 9, 2008.

BACKGROUND OF THE INVENTION

The invention is directed to a process to prepare a gas mixture of hydrogen and carbon monoxide from an ash containing carbonaceous feedstock.

Such a process is described in U.S. Pat. No. 4,474,584. In this process a coal is subjected to a partial oxidation. A mixture of liquid ash, solids and hydrogen and carbon monoxide is quenched with water and subsequently passed through a diptube into a bath of liquid water. The gaseous components and some solids are subsequently passed via a venturi mixer to a scrubber vessel. The ash particles in the water which leave the scrubber are removed in a hydrocyclone. The cleaned water is subsequently used as quench water.

A disadvantage of this process is that three types of water effluents are produced, namely a water stream from the hydrocyclone rich in solid ash, a water stream rich in solid ash as disposed from the water bath and a water stream less rich in solids as discharged from the same water bath. The number of effluent streams introduce complexity to the water treatment system. There exists a desire to simplify this process.

A further concern with the prior art process is that it does not disclose an efficient re-use of water. Especially in processes, which consume water, like coal to liquids (CTL) processes, re-use of water is important to minimize the consumption of water. Water is required to provide the hydrogen in a coal to liquids process involving partial oxidation of coal, a water gas shift process step and a Fischer-Tropsch process step.

SUMMARY OF THE INVENTION

The present invention provides a process to prepare a gas mixture of hydrogen and carbon monoxide from an ash containing carbonaceous feedstock comprising the following steps, (i) partial oxidation of the ash containing carbonaceous feedstock with an oxygen containing gas thereby obtaining liquid ash and a gas mixture comprising hydrogen, carbon monoxide and solids, (ii) separating more than 90 wt % of the liquid ash from the gas mixture, (iii) reducing the temperature of the gas mixture, in the absence of the separated ash, (iv) scrubbing the cooled gas mixture of step (iii) by contacting with liquid water to obtain a scrubbed gas and a water effluent containing ash, (v) separating the ash from the water effluent by means of a decanter centrifuge thereby obtaining a wet ash and a stream of water poor in ash.

DETAILED DESCRIPTION OF THE INVENTION

Figure 1:
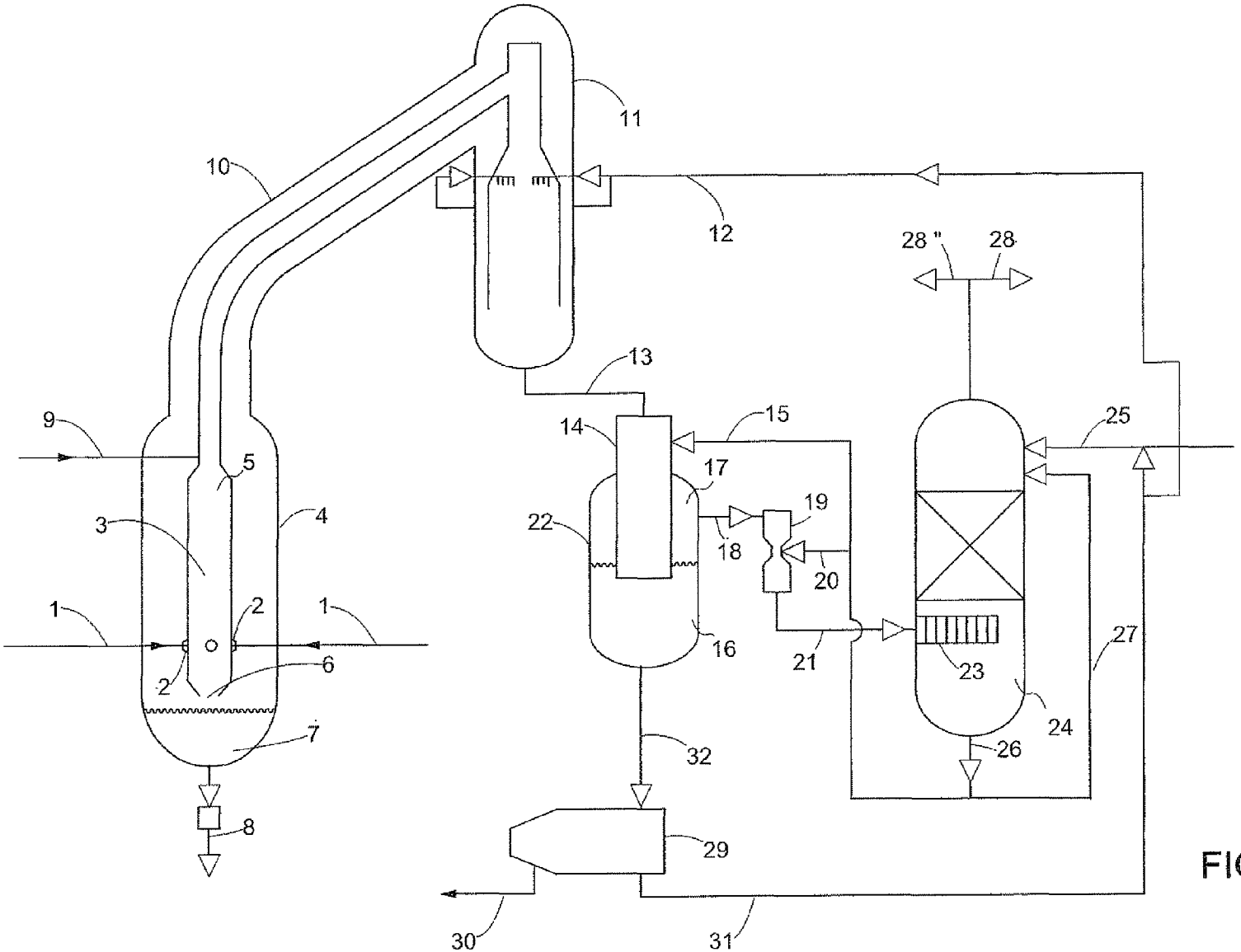
FIG. 1 is a schematic illustration of a process according to the present invention.

Applicants have found it possible to separate ash from the water by means of centrifugal force, i.e. by means of a so-called decanter centrifuge. Without wanting to be bound to the following theory it is believed that this separation is possible due to the powdery nature of the ash. Decanter centrifuges are well known and are described in Perry's Chemical Engineers' Handbook, 7th edition, Robert H. Perry, McGraw-Hill Companies, 1997, ISBN 0-07-049841-5, pages 18-113-18-115. Preferably a flocculant additive is added to the water stream to enhance the separation. Examples of suitable flocculants are the so-called cationic polymer type or non-ionic latex polymers, more preferably of the oil emulsified type. An example of such a flocculant is NALCO 71760. The use of a decanter centrifuge has been found advantageous because on the one hand ash with a low amount of water content in the wet ash is obtained and one the other hand water suited to be reused is obtained, wherein the apparatus occupies a relatively small space. The wet ash can be disposed of as landfill or as a component for cement.

Preferably the water stream poor in ash as obtained in the above decanter centrifuge is further cleaned in a conventional centrifuge to separate the majority of the ash still present in said water. This obtained cleaned water can then be advantageously used in any water gas contacting step wherein the water is added via injection nozzles as used in some of the preferred embodiments of this invention as described below. Injection nozzles are prone to be clogged by ash present in the water. Especially when introducing water as a mist as described below such further cleaning of the water is found to be attractive.

Examples of suitable centrifuge separators are so-called disk-centrifuge bowls as described in Perry's Chemical Engineers' Handbook, 7th edition, Robert H. Perry, McGraw-Hill Companies, 1997, ISBN 0-07-049841-5, page 18-113.

Preferably the decanter centrifuge is nitrogen blanketed to prevent oxidation of sulphur components as present in the effluent water. Oxidation of sulfides to sulfates is avoided in this manner. This is advantageous to avoid the formation of gypsum when calcium compounds are present in the feedstock to step (i). Calcium compounds, in the form of limestone are sometimes added to the feedstock of step (i) to influence the properties of the slag as deposited on the wall of the gasification chamber.

The process conditions and feedstocks in step (i) are commonly known. Preferably step (i) is performed in a so-called entrained flow gasifier. The partial oxidation of the ash containing carbonaceous feedstock suitably takes place at a temperature of between 1200 and 1800° C. preferably between 1400 and 1800° C. at a pressure of between 2 and 10 MPa. The solid carbonaceous feed is partially oxidized with an oxygen comprising gas. Preferred carbonaceous feeds are solid, high carbon containing feedstocks, more preferably it is substantially (i.e. >90 wt. %) comprised of naturally occurring coal or synthetic (petroleum) cokes, most preferably coal. Suitable coals include lignite, bituminous coal, sub-bituminous coal, anthracite coal, and brown coal. Another suitable feedstock is biomass. The ash content in the feedstock is suitably between 2 and 40 wt %. The solid feedstock may be supplied to a partial oxidation burner in the form of a slurry with water or liquid carbon dioxide or in the form of a powder and a carrier gas. Suitable carrier gasses are for example nitrogen, carbon dioxide or recycled synthesis gas.

The gasification is preferably carried out in the presence of oxygen and optionally some steam, the purity of the oxygen preferably being at least 90% by volume, nitrogen, carbon dioxide and argon being permissible as impurities. Substantially pure oxygen is preferred, such as prepared by an air separation unit (ASU). Oxygen may contain some steam. Steam acts as a moderator gas in the gasification reaction. The ratio between oxygen and steam is preferably from 0 to 0.3 parts by volume of steam per part by volume of oxygen. The oxygen used is preferably heated before being contacted with the coal, preferably to a temperature of from about 200 to 500° C.

If the water content of the carbonaceous feed, as can be the case when for example lignite is used as feedstock, is too high, the feedstock is preferably dried before use.

The partial oxidation reaction is preferably performed by combustion of a dry mixture of fine particulates of the carbonaceous feed and a carrier gas with oxygen in a suitable burner. The burner or burners fire into a gasification chamber as present in a gasification reactor vessel. Examples of suitable burners are described in U.S. Pat. No. 4,888,7962, U.S. Pat. No. 4,523,529 and U.S. Pat. No. 4,510,874. The gasification chamber is preferably provided with one or more pairs of partial oxidation burners, wherein said burners are provided with supply means for a solid carbonaceous feed and supply means for an oxygen containing stream. With a pair of burners is here meant two burners, which are directed horizontal and diametric into the gasification chamber. This results in a pair of two burners in a substantially opposite direction at the same horizontal position. The reactor vessel may be provided with 1 to 5 of such pairs of burners. The upper limit of the number of pairs will depend on the size of the reactor. The firing direction of the burners may be slightly tangential as for example described in EP-A-400740.

The liquid ash as formed under the temperature conditions in step (i) will deposit on the wall of the gasification chamber and will flow in a downwardly direction to the lower end of said chamber. Suitably the liquid ash will be discharged from said chamber via an opening at the lower end of the gasification chamber and the gas mixture comprising hydrogen, carbon monoxide and solids will be discharged from said chamber via an opening in the upper end of said chamber. This is the preferred method to perform step (ii), wherein more than 90 wt % of the liquid ash as formed in the gasification chamber will be separated from the gas mixture before said gas mixture is reduced in temperature.

The liquid ash as it is discharged from the gasification chamber will fall into a water bath. The slag in the form of slag pieces and slag fines are discharged with part of the water from the water bath via a sluice system as for example described in EP-B-1224246. The slag particles are separated from the water resulting in a water effluent containing slag fines. The slag fines are preferably separated from the water effluent, preferably by means of a decanter centrifuge, and the cleaned water is recycled to the water bath. The decanter centrifuge and its operation may be as described above. This method of operating and re-using this water enables one to further limit the discharge of liquid water to the environment.

In step (iii) the temperature of the gas mixture, in the absence of the separated ash, as obtained in step (ii) is reduced from a temperature above 1000° C., i.e. a temperature of step (i) as described above, to a temperature below 900° C.

The reduction in temperature is preferably performed by contacting the gas mixture with a gaseous and/or liquid quench medium in order to reduce the temperature to between 400 and 900° C. This cooling step is preferred to achieve a gas temperature below the solidification temperature of the non-gaseous components, i.e. ash, present in the hot synthesis gas. The solidification temperature of the non-gaseous components in the hot synthesis gas will depend on the carbonaceous feed and is usually between 600 and 1000° C. The cooling step is preferably performed in a connecting conduit that fluidly connects the gasification chamber with a downstream zone where further cooling takes place, such as the cooling vessel as described in the aforementioned WO-A-2007125046. Cooling with a gas quench is well known and described in for example EP-A-416242, EP-A-662506 and WO-A-2004/005438. Examples of suitable quench gases are recycle synthesis gas and steam. In the context of the present invention the term recycle synthesis gas is part of the scrubbed gas mixture of hydrogen and carbon monoxide as obtained in step (iv). An example of a liquid quench medium is water, for example process water as obtained from a downstream process. More preferably the contacting with water is performed by injecting a mist of liquid water into the gas mixture as will be described below. The quenched gas mixture is suitably passed through a vertically positioned diptube wherein water is added to the gas mixture flowing through the diptube to obtain a gas/water mixture. Alternatively the quenched gas mixture is first further reduced in temperature in the manner described here below before performing this step.

In a possible subsequent cooling step the quenched gas is preferably further reduced in temperature by contacting the gas with a mist of liquid droplets. Preferably the liquid is substantially comprised of water (i.e. >95 vol %). In such an embodiment the temperature reduction in said subsequent cooling step is suitably from a temperature between 700 and 900° C. to a temperature between 400 and 700° C.

With the term 'mist' is meant that the liquid is injected in the form of small droplets. If water is to be used as the liquid, more preferably more than 90%, of the water is in the liquid state. Preferably the injected mist has a temperature of at most 50° C. below the bubble point at the prevailing pressure conditions at the point of injection, particularly at most 15° C., even more preferably at most 10° C. below the bubble point. To this end, if the injected liquid is water, it usually has a temperature of above 90° C., preferably above 150° C., more preferably from 200° C. to 230° C. The temperature will obviously depend on the operating pressure of the gasification reactor, i.e. the pressure of the gas mixture as specified further below. Hereby a rapid vaporization of the injected mist is obtained, while cold spots are avoided. As a result the risk is reduced of ammonium chloride deposits and local attraction of ashes on the vessel internals of the vessel in which said subsequent cooling step is performed.

Further it is preferred that the mist comprises droplets having a diameter of from 50 to 200 μm, preferably from 100 to 150 μm. Preferably, at least 80 vol. % of the injected liquid is in the form of droplets having the indicated sizes. To enhance cooling of the gas mixture, the mist is preferably injected with a velocity of 30-90 m/s, preferably 40-60 m/s. Also it is preferred that the mist is injected with an injection pressure of at least 10 bar above the operating pressure of step (i), preferably from 20 to 60 bar, more preferably about 40 bar, above this pressure. If the mist is injected with an injection pressure of below 10 bar above the pressure of step (i), the droplets of the mist may become too large. The latter may be at least partially offset by using an atomization gas, which may e.g. be $N_2$, $CO_2$ or more preferably steam or recycle synthesis gas. Using atomization gas has the additional advantage that the difference between injection pressure and the pressure of the raw synthesis gas may be reduced to a pressure difference of between 5 and 20 bar.

The mist as added in said subsequent cooling will suitably totally evaporate. According to an especially preferred embodiment, the amount of injected mist is selected such that the raw synthesis gas as obtained in step (iii) comprises at least 40 vol. % $H_2O$, preferably from 40 to 60 vol. % $H_2O$, more preferably from 45 to 55 vol. % $H_2O$ in the gaseous form.

The gas mixture obtained in step (iii) is passed through a vertically positioned diptube wherein water is added to the gas mixture flowing through the diptube to obtain a gas/water mixture. Preferably water is added by spraying water into the flow of downwardly moving gas mixture within the diptube.

Water is separated from the gas/water mixture as obtained in the previous step by passing this gas/water mixture through a water bath as present at the lower end of the diptube. The gas passes the water bath to be discharged to a space above the water bath. An effluent stream of water containing solid ash particles is discharged from the water bath via a discharge conduit fluidly connected to said water bath. The diptube and water bath are preferably present in a vessel. The main function of this step is to remove the majority of the ash as present in the gas mixture obtained in step (iii) such that the ash content in the gas as fed to a preferred downstream venturi mixer is low enough to avoid excessive wear in said mixer. Preferably more than 80 wt % of the ash as present in the gas mixture obtained in step (iii) is separated from this gas mixture.

In a next step the gas obtained together with an amount of liquid water is passed through a venturi mixer. Venturi mixers and their use are well known and will not be described in detail.

In step (iv) the gas obtained is passed upwardly through a scrubber. The scrubber is a vessel in which the gas contacts a stream of liquid water. The vessel may be substantially empty as in a so-called counter-current spray column or may be provided with a packing as in a packed bed scrubber. Preferably the scrubber in step (iv) is provided with a gas inlet device which directs the gas substantially upwardly and the liquid as present in the gas substantially downwardly. Such a gas inlet device may be a vane inlet device as for example described in GB-A-1119699. Other features of the scrubber and its operation shall not be described in detail, as they are commonly known.

The downwardly moving water stream in the scrubber of step (iv) preferably has an initial pH of between 6.5 and 7.5, wherein the pH is the pH of the water as it is supplied to the scrubber. The pH is preferably within this range to achieve maximum scrubbing efficiency and avoid corrosion issues. The pH is preferably maintained within this range by adding a caustic solution.

In step (iv) the gas contacts a stream of downwardly moving liquid water thereby obtaining a scrubbed gas mixture of hydrogen and carbon monoxide and used water. Preferably part of the used water is recycled within step (iv) to the upper end of the scrubber. Preferably part of the used water is also used in the venturi scrubber step. Preferably fresh water is added to the upper end of the scrubber. In this process most of or preferably all of the fresh water as added to the process in step (iv) will be discharged from the process as the effluent stream of water. This single effluent stream containing mostly water and ash, is subjected to step (v), wherein the ash is separated from the water effluent by means of a decanter centrifuge thereby obtaining a wet ash and a stream of water poor in ash.

The invention shall be illustrated by making use of the following Figure. In FIG. 1, an ash containing carbonaceous feedstock and an oxygen containing gas are fed via 1 to a pair of burners 2. The burners fire into a gasification chamber 3 as present in gasification vessel 4. In gasification chamber 3 a gas mixture comprising hydrogen and carbon monoxide is produced. This gas mixture is discharged from the gasification chamber 3 via an upper opening 5 of said chamber 3. Liquid ash is discharged from said chamber via lower opening 6 of said chamber 3 to a water bath 7. The slag and part of the water is discharged from the gasification reactor vessel 4 via a sluice system 8. The gas mixture, after it has been discharged from the gasification chamber 3 is reduced in temperature by injection of a gaseous quench or liquid water quench system 9. The partly cooled gas mixture is passed via a connecting duct 10 to a quench vessel 11 for a subsequent cooling step. In quench vessel 11 water is sprayed into the gas mixture via injectors 12 to obtain a gas mixture having a temperature below 500° C.

The gas mixture is subsequently passed via conduit 13 to the upper end of diptube 14. To said diptube 14 water is added via 15. The resultant gas/water mixture flows through water bath 16, wherein liquid water separates from the gas/water. The gas mixture is discharged to a space 17 above the water bath 16 and effluent water is discharged from the water bath via a discharge conduit 32 fluidly connected to said water bath 16. Water bath 16, space 17 and diptube 14 are present in vessel 22. The gas mixture is fed from space 17 to a venturi mixer 19 via conduit 18. To venturi mixer 19 liquid water is added via 20. The effluent of the venturi mixer 19 is fed via conduit 21 to a gas inlet device 23 as present in scrubber 24. The inlet device 23 directs the gas substantially upwardly and the liquid substantially downwardly. To the scrubber 24 fresh water is added via 25. The used water is discharged from the scrubber 24 via conduit 26. Part of the used water is recycled via conduit 27 to the upper part of the scrubber vessel 24, part is used in venturi mixer 19 via 20 and part is added to diptube 14 via 15. The scrubbed gas is partly discharged via conduit 28 as the product gas and partly recycled via 28" as quench gas in quench system 9 and/or as atomization gas in the injectors 12 of quench vessel 11.

The water as discharged via discharge conduit 32 is fed to a decanter centrifuge 29 in which the water is separated in a stream 30 rich in ash and a water stream 31 substantially free of ash. The water stream 31 is preferably recycled to step (iv) via conduit 25 and/or to step (iii) when fed to injectors 12.

Figure 2:
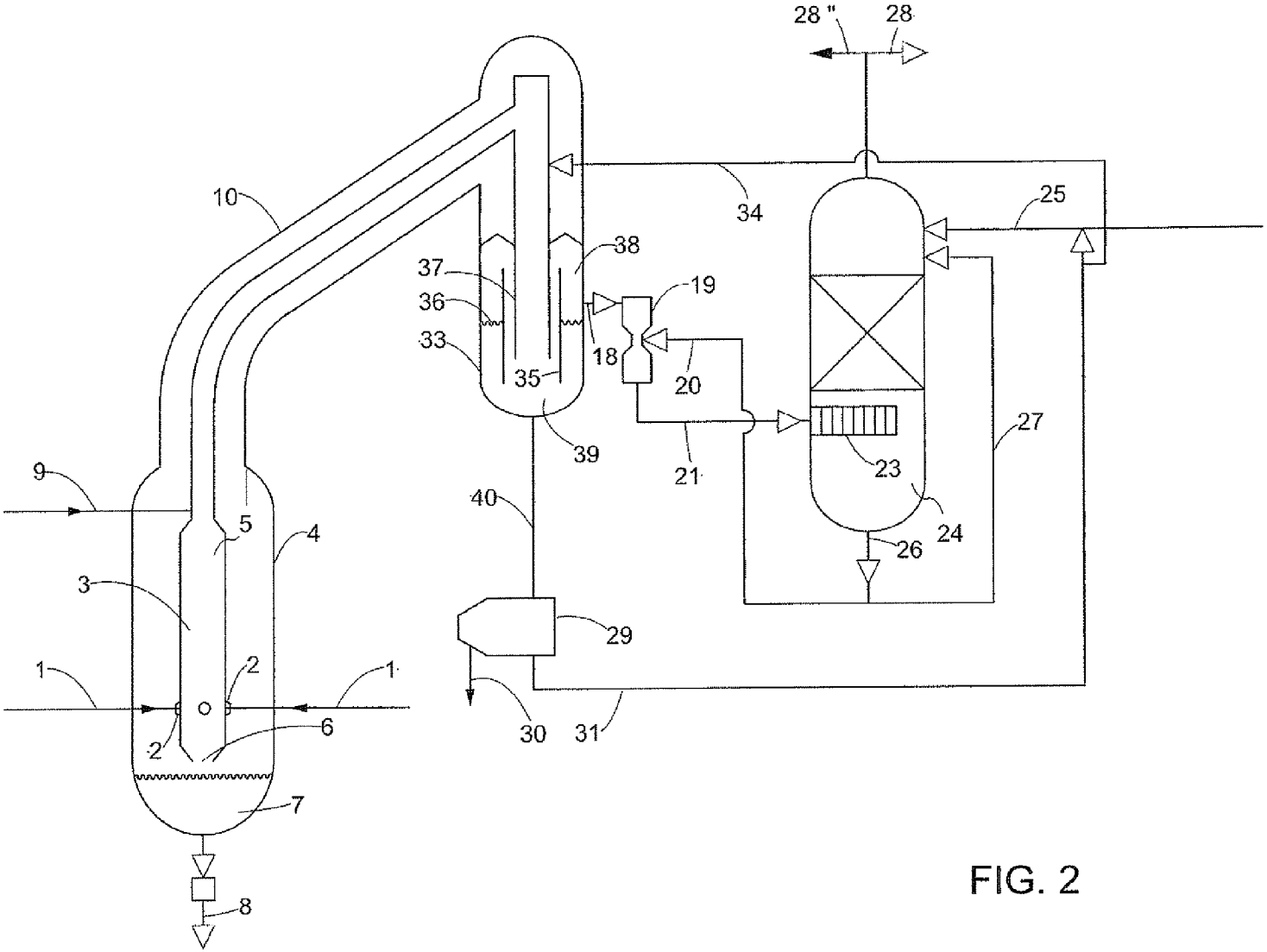
FIG. 2 is a schematic illustration of another process according to the present invention.

FIG. 2 shows another embodiment of the present invention. Reference signs 1-31 have the same meaning as in FIG. 1. In FIG. 2 the partly cooled gas mixture is passed via a connecting duct 10 to the upper end of diptube 37 as present in vessel 33. To said diptube 37 water is added via conduit 34. The resultant gas/water mixture flows through water bath 39, wherein liquid water separates from the gas/water stream. The gas mixture is discharged to a space 38 above the water bath level 36. Effluent water is discharged from the water bath via a discharge conduit 40 fluidly connected to said water bath 39. A draft tube 35 is present to guide the gas through an annulus as present between said draft tube 35 and lower end of diptube 37. The gas mixture is fed from space 38 to a venturi mixer 19 via conduit 18. The water stream 31 is preferably recycled to step (iv) via conduit 25 and/or to the diptube via conduit 34.

The invention is illustrated by the following mass balance. To a gasification reactor an ash containing coal was fed. Table 1 illustrates the important streams of the mass balance, where the numbers refer to those in FIG. 1. In this example part 28" is recycled to the gasification reactor 4 to be used as quenching gas via system 9 and to quench vessel 11 to be used as atomization gas in injectors 12. The mass balance was calculated using models and experimental evidence.

TABLE 1

| Stream number | 8 | 12 | 13 | 32 | 25 | 28 |
|---|---|---|---|---|---|---|
| Temperature (° C.) | 65 | 214 | 425 | 213 | — | 214 |
| $H_2$ + CO (tons/day) | — | — | 7493 | — | — | 4867 |

TABLE 1-continued

| Stream number | 8 | 12 | 13 | 32 | 25 | 28 |
|---|---|---|---|---|---|---|
| slag (tons/day) | 203 | — | — | — | — | — |
| Ash (tons/day) | — | — | 140 | 140 | — | — |
| Water (tons/day) (liquid or gaseous) | 97 | 2514 | — | 4527 | 7778 | 5754 |

The above mass balance shows that almost all the water added via stream 25 leaves the process as part of stream 28. Only a small percentage is discharged with the ash via the decanter centrifuge.

Example Decanter Centrifuge

To 400 l water 20 kg ash dust was added while being continuously mixed. The ash had been obtained from a commercially operated Shell Coal Gasification Process in its dry solids removal unit. This mixture is representative for a mixture as would be obtained in streams 32 and 40 of FIGS. 1 and 2 respectively.

To a decanter centrifuge type CA 225-01-33 of Westfalia Separator AG the above water mixture was continuously fed whereby the discharge rate was varied. The bowl rotation was kept at 4750 rotations per minute.

The scroll rotations was 6 rotations per minute, expect for run number 5 were the scroll speed was 7 rotations per minute to compensate for the different feed composition. The results are presented in Table 2.

In Run #5 also 100 l/h of a water mixture was added containing 200 g of a flocculent K 144 L of Ashland Deutschland GmbH per 100 l of water.

TABLE 2

| Run number | Discharge rate (l/h) | Solids in effluent water (% v/v) | Solids content in ash rich effluent (wt %) | Torque % |
|---|---|---|---|---|
| 1 | 500 | Traces | 84.83 | 48 |
| 2 | 1000 | Traces | 83.44 | 51 |
| 3 | 1500 | 0.03 | 82.59 | 60 |
| 4 | 2000 | 0.04 | 81.70 | 67 |
| 5 | 2000 | 0.02 | 80.48 | 63 |

What is claimed is:

1. A process to prepare a gas mixture of hydrogen and carbon monoxide from an ash containing carbonaceous feedstock comprising the following steps, (i) partial oxidation of an ash containing carbonaceous feedstock with an oxygen containing gas thereby obtaining liquid ash and a gas mixture comprising hydrogen, carbon monoxide and solids, (ii) separating more than 90 wt % of the liquid ash from the gas mixture before reducing the temperature of the gas mixture, (iii) reducing the temperature of the gas mixture, in the absence of the separated ash, to obtain a cooled gas mixture, (iv) scrubbing the cooled gas mixture by contacting with liquid water to obtain a scrubbed gas and a water effluent containing ash, and (v) separating the ash from the water effluent by means of a decanter centrifuge thereby obtaining a wet ash and a stream of water poor in ash;

wherein steps (i) and (ii) are performed in a reactor vessel provided with horizontally firing burner nozzles, which nozzles discharge a gas mixture comprising hydrogen, carbon monoxide and solids into a gasification chamber as present in the reactor vessel, and wherein liquid ash is present on the interior wall of the gasification chamber, wherein the gas mixture is discharged through an opening at the upper end of the gasification chamber and the liquid ash is discharged via an opening at the lower end of the gasification chamber.

2. A process according to claim 1, wherein the stream of water poor in ash is recycled to step (iv).

3. A process according to of claim 1, wherein the feedstock to step (i) contains a calcium compound and wherein the decanter centrifuge is nitrogen blanketed to prevent oxidation of sulphur components as present in the water effluent.

4. A process according to claim 1, wherein the stream of water poor in ash as obtained in step (v) is further cleaned in a centrifuge to obtain cleaned water.

5. A process according to claim 1, wherein in step (iii) the temperature of the gas mixture is reduced, in the absence of the separated ash, from a temperature above 1000° C. to a temperature below 900° C. by contacting the gas mixture with a gaseous and/or liquid quench medium.

6. A process according to claim 1, wherein the liquid water in step (iv) has an initial pH of between 6.5 and 7.5.

7. A process according to claim 1, wherein the carbonaceous feedstock is coal.

8. A process according to claim 1, wherein in step (iii) the temperature of the gas mixture is reduced, in the absence of the separated ash, from a temperature above 1000° C. to a temperature below 900° C.

* * * * *